US010653234B2

(12) United States Patent
Cordero et al.

(10) Patent No.: US 10,653,234 B2
(45) Date of Patent: May 19, 2020

(54) BRUSH APPARATUS

(71) Applicants: Crystal N Cordero, Lakeland, FL (US); Mario A Garcia, Lakeland, FL (US)

(72) Inventors: Crystal N Cordero, Lakeland, FL (US); Mario A Garcia, Lakeland, FL (US)

( * ) Notice: Subject to any disclaimer, the term of this patent is extended or adjusted under 35 U.S.C. 154(b) by 330 days.

(21) Appl. No.: 15/903,742

(22) Filed: Feb. 23, 2018

(65) Prior Publication Data

US 2018/0310700 A1 Nov. 1, 2018

Related U.S. Application Data

(60) Provisional application No. 62/504,675, filed on May 11, 2017, provisional application No. 62/490,359, filed on Apr. 26, 2017.

(51) Int. Cl.
*A46B 5/00* (2006.01)
*A46B 9/02* (2006.01)

(52) U.S. Cl.
CPC ..... *A46B 9/028* (2013.01); *A46B 5/0008* (2013.01); *A46B 5/0016* (2013.01); *A46B 9/021* (2013.01); *A46B 2200/10* (2013.01); *A46B 2200/1046* (2013.01); *A46B 2200/1053* (2013.01)

(58) Field of Classification Search
CPC ..... A46B 5/0016; A46B 2200/102; A46B 2200/1046; A46B 5/008; A46B 9/021; A46B 9/028; A46B 2200/10
See application file for complete search history.

(56) References Cited

U.S. PATENT DOCUMENTS 2,528,992 A * 11/1950 Barr ..... A46B 5/0016 15/167.2
D401,418 S * 11/1998 Vrignaud ..... D4/106
5,934,762 A * 8/1999 Vrignaud ..... A46B 5/0012 15/106

* cited by examiner

*Primary Examiner* — Shay Karls

(57) ABSTRACT

A brush apparatus has a handle, a first brush, a second brush and a third brush. The handle is located in between the first brush and the second brush, the handle is located in between the first brush and the third brush, the second brush and the third brush are located adjacent to each other, each of the first brush, the second brush and the third brush is laterally connected with the handle, the first brush has a plurality of first bristles, the plurality of first bristles are distributed in a hexagonal array, the second brush has a plurality of second bristles, the plurality of second bristles are distributed in a partial-radial array, the third brush has a plurality of third bristles, and the plurality of third bristles are distributed in a linear array.

20 Claims, 17 Drawing Sheets

BRUSH APPARATUS

The current application claims a priority to the U.S. Provisional Patent application Ser. No. 62/490,359 filed on Apr. 26, 2017 and to the U.S. Provisional Patent application Ser. No. 62/504,675 filed on May 11, 2017.

FIELD OF THE INVENTION

The present invention relates generally to a brush apparatus with three brushes disposed on two ends of a handle. More particularly, the present invention relates to a makeup brush apparatus with the three brushes that are configured to be served as a lip exfoliator, a lip scrub applicator and a lip primer.

BACKGROUND OF THE INVENTION

In an era where beauty routines and cosmetic products continue to advance on a daily basis, the beauty industry is recognized as a fast-paced, ever-evolving, new-and-improved market place. Yet when it comes to lip care, time seems to be standing still. Specifically, when it comes to lip exfoliation tools, consumers simply do not have the commensurate options that exist in many of the other areas.

For example, instruction labels for lip exfoliants recommend consumers apply the product using fingers, which provides the least effective method to receive a rich lather and achieve a deep exfoliation. Moreover, using one's finger may require more product to fulfill a higher grade of exfoliation. As a solution, lip scrub users opt for items such as mascara wands and toothbrushes which are not only abrasive, but many of which are petroleum based and potentially toxic. Yet, named items are being misused for lack of an available, properly designed beauty tool that does not negatively impact the user, create health risks, produce harmful effects from long term usage, and pose a threat to the environment. In short, there is no safe applicator option for lip scrubs.

The option of using an old brush is often preferred over a new brush, as the bristles are frayed, tattered, and worn, so users opt for a seemingly safer and gentler surface. Dental experts and research show this is not only unhygienic, but is a major health concern for lips as old toothbrushes carry significant, embedded buildup of dental plaque, hardened toothpaste, bacteria film secretions and saliva, and even small deposits of food. When removing dry, chapped skin cells, bacteria can easily enter through cracks in the lips and lead to fungal and bacterial diseases such as Angular Cheilitis.

Furthermore, using a new toothbrush presents its own set of risks. The bristles of a new toothbrush are not designed for the lip's surface, as they are too firm and stiff to use on soft, delicate skin and can even pierce or rub the skin raw. Most toothbrushes use petroleum based materials and bristles which are potentially toxic. Specifically, the use of medium or hard bristles should be avoided as using such abrasive techniques on lip sensitive surfaces may lead to adverse and harmful effects for the skin's elasticity, and can be more damaging over time. In example, as humans age, there is a loss of skin elasticity, as well as a decrease of collagen production, all of which are essential to lips for providing plumpness and fullness, and countering wrinkles. This makes this particular skin more vulnerable to rough interaction, susceptible to wrinkles, and threatens the ability to return to its natural fullness with repeated exposure to such harmful practices.

Of these egregiously, outdated methods of exfoliating lips, the technique that poses the greatest potential health risk, is also sworn by top beauty artists, magazines, and bloggers. The toothbrush method consists of using an old, new, or actively-in-use toothbrush to scrub away broken and chapped skin from the lip's surface. The variations of this method are as troubling as they are vast, including harmful and abrasive techniques such as using dry soft, medium, or hard bristled brushes on dry and sensitive skin. Other techniques being used range from using one's finger to old mascara wands, cottons swabs, and washcloths. Additionally, none of these products were designed to interact with the delicate nature of the lips which is made up of 2-3 layers of skin versus the face which has 16 layers of skin. This is demonstrated by the fact that many of these products contain harsh materials that are detrimental to the skin's surface, as they were never designed to perform as lip exfoliators, lip scrub applicators or lip priming devices.

It is therefore an objective of the present invention to provide a brush apparatus that is able to solve the above-mentioned problems.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention replaces the most highly unconventional and unsanitary ad hoc techniques used in attempts to achieve the perfect pout. Specifically, beauty product consumers and experts have resorted to combining items that were neither engineered, designed, nor intended to be used to perform lip care functions.

Figure 1:
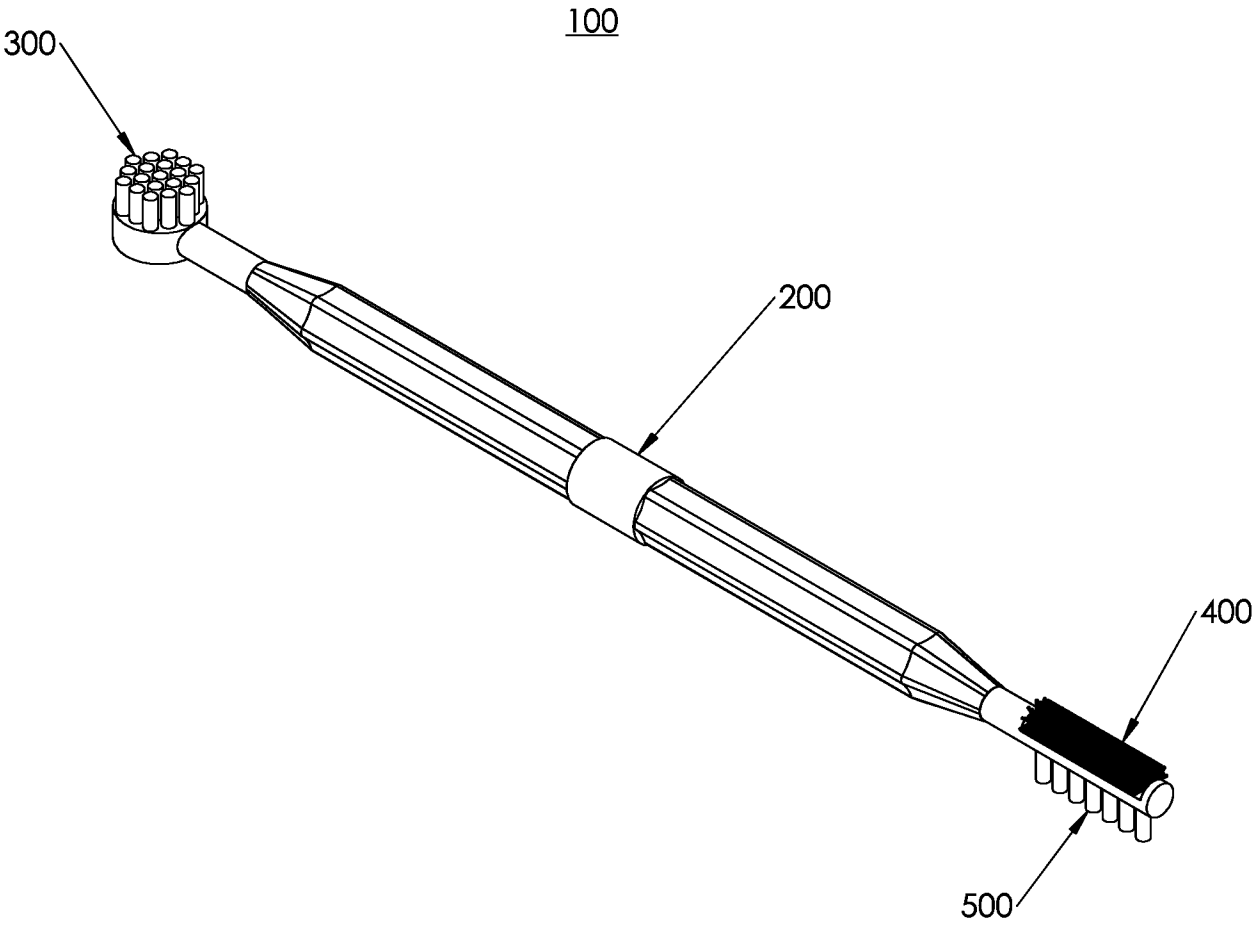
FIG. 1 is a perspective view depicting a brush apparatus with a handle, a first brush, a second brush and a third brush according to an embodiment of the present invention.
Figure 2:
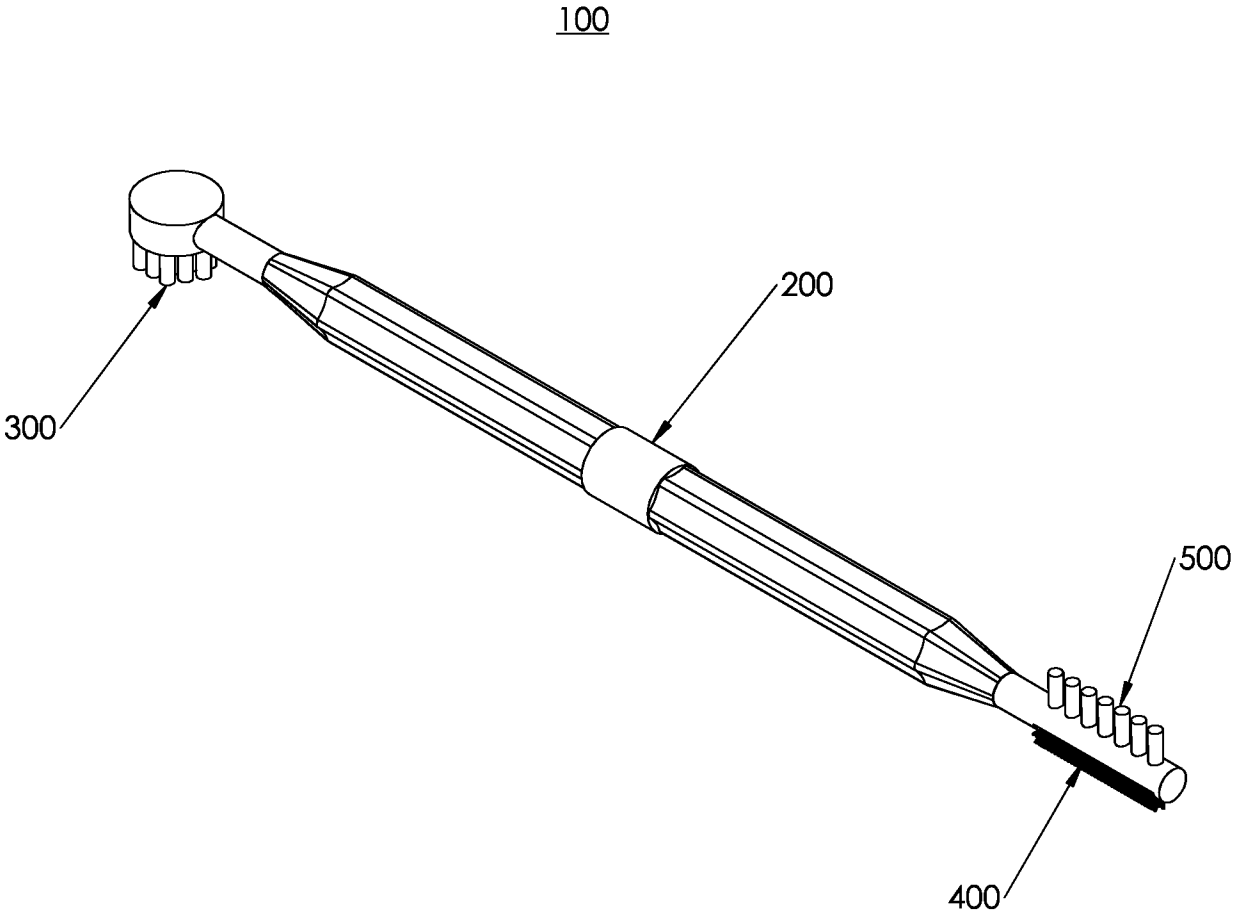
FIG. 2 is another perspective view depicting the brush apparatus according to an embodiment of the present invention.
Figure 3:
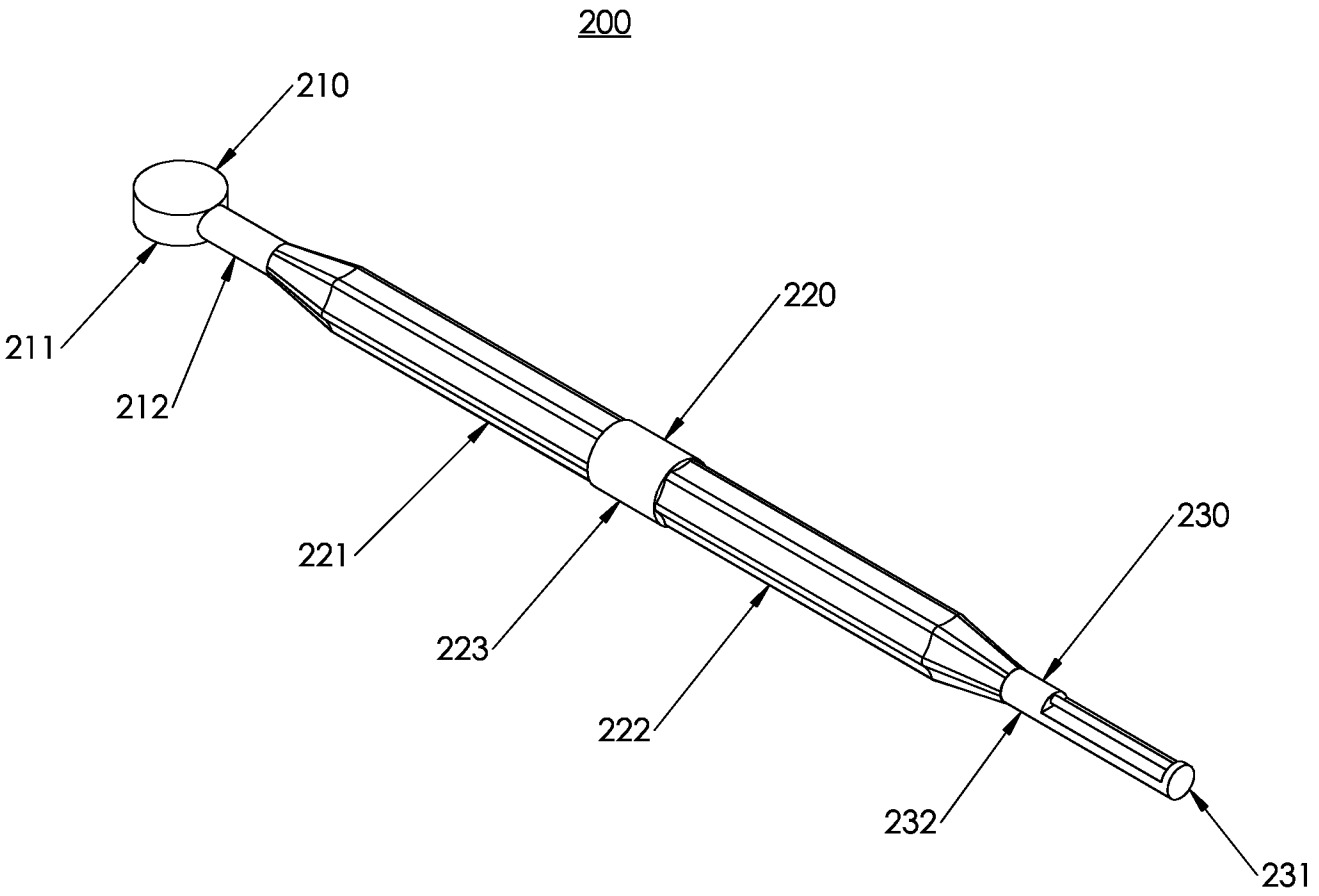
FIG. 3 is a perspective view depicting the handle with a first portion, an intermediate portion and a second portion according to an embodiment of the present invention.
Figure 4:
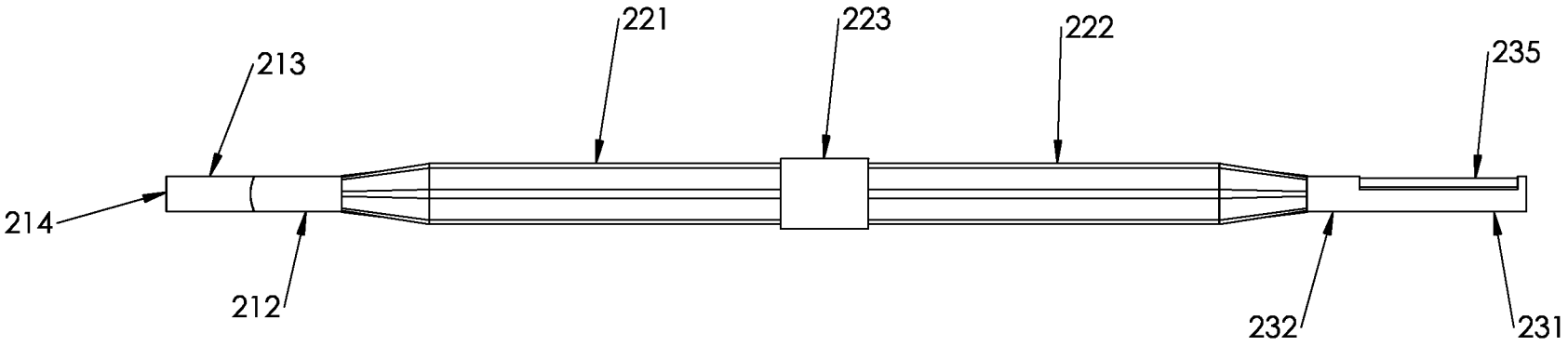
FIG. 4 is a front view depicting the handle according to an embodiment of the present invention.
Figure 5:
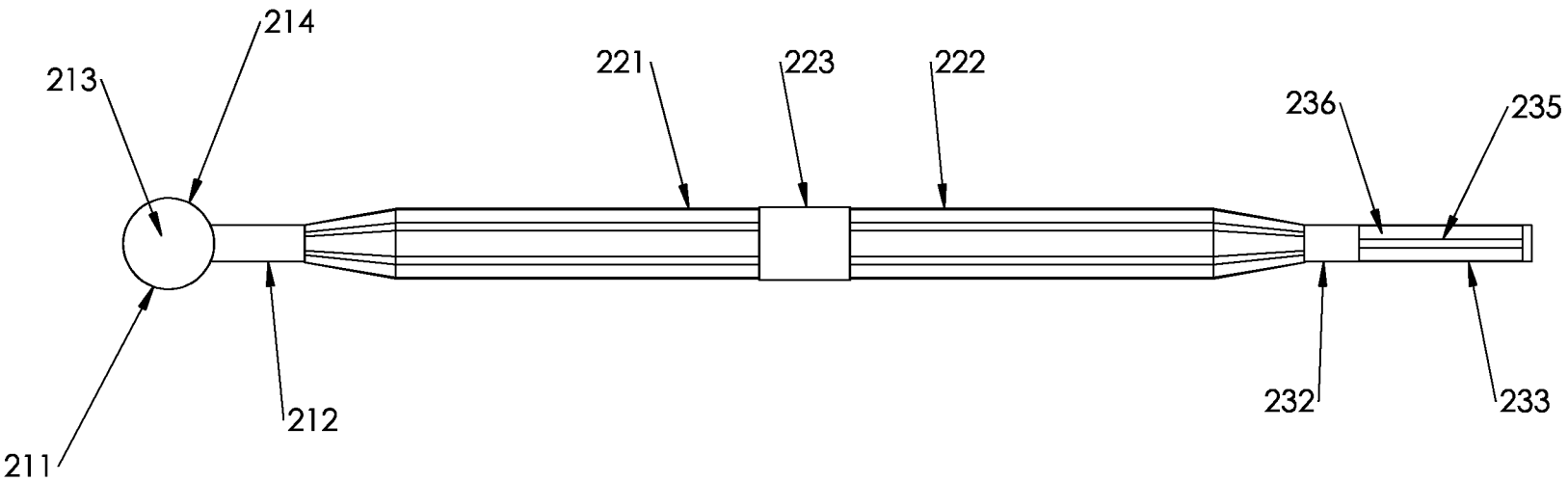
FIG. 5 is a top view depicting the handle according to an embodiment of the present invention.
Figure 6:
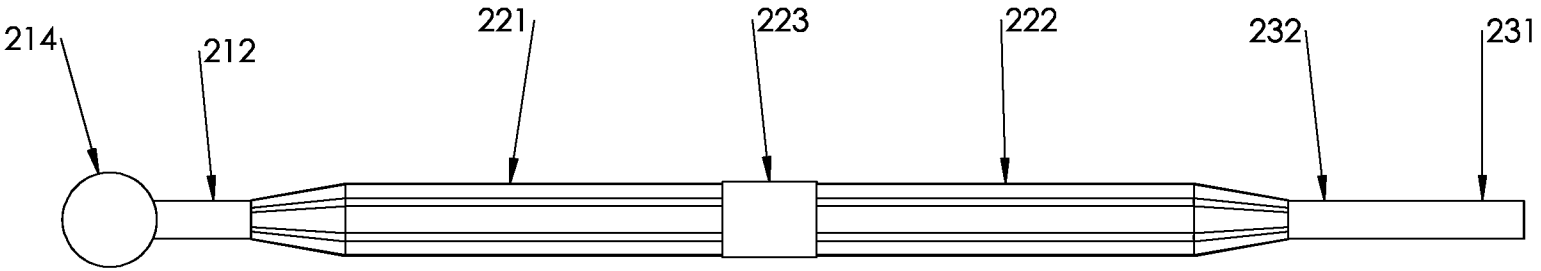
FIG. 6 is a bottom view depicting the handle according to an embodiment of the present invention.
Figure 7:
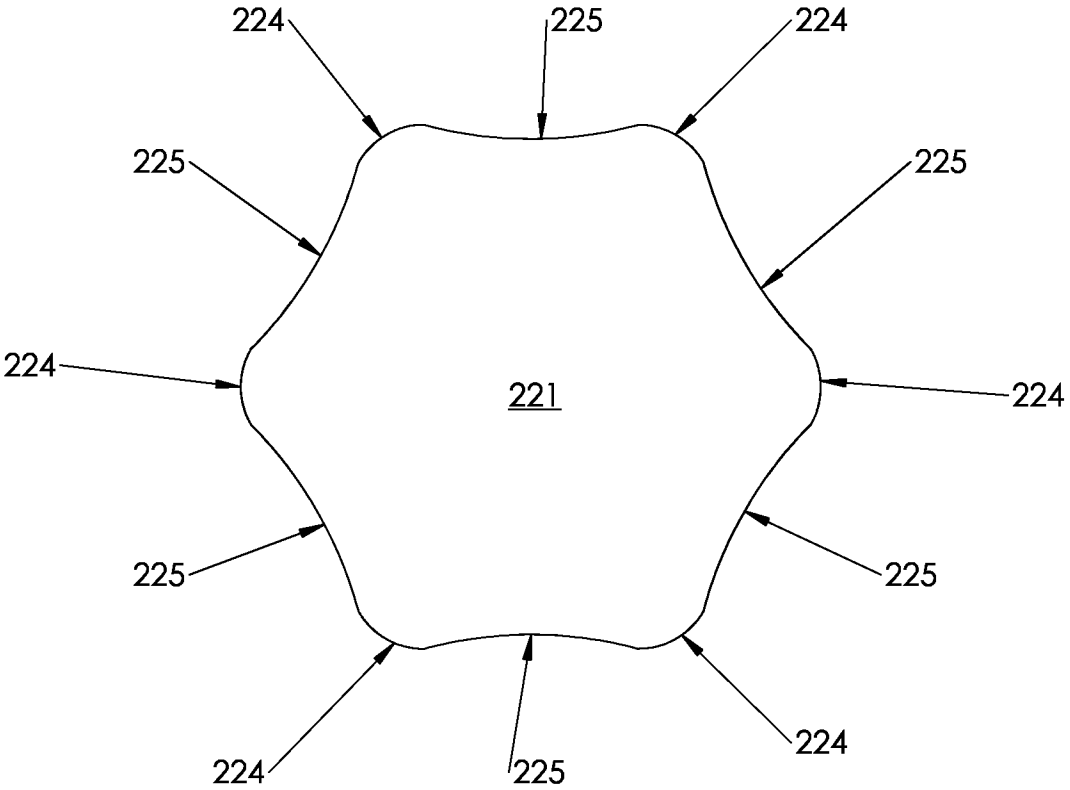
FIG. 7 is a cross-sectional view depicting a cross section of a first gripping segment of the intermediate portion according to an embodiment of the present invention.
Figure 8:
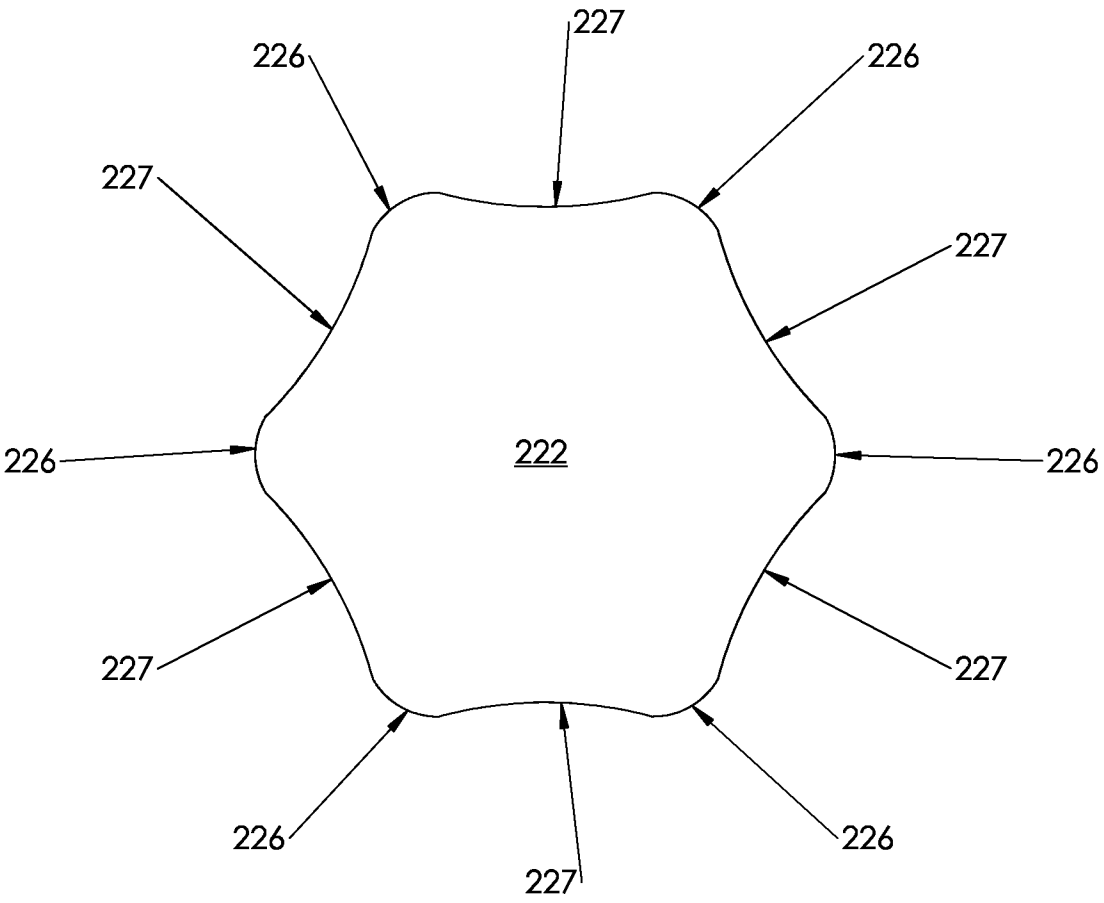
FIG. 8 is a cross-sectional view depicting a cross section of a second gripping segment of the intermediate portion according to an embodiment of the present invention.
Figure 9:
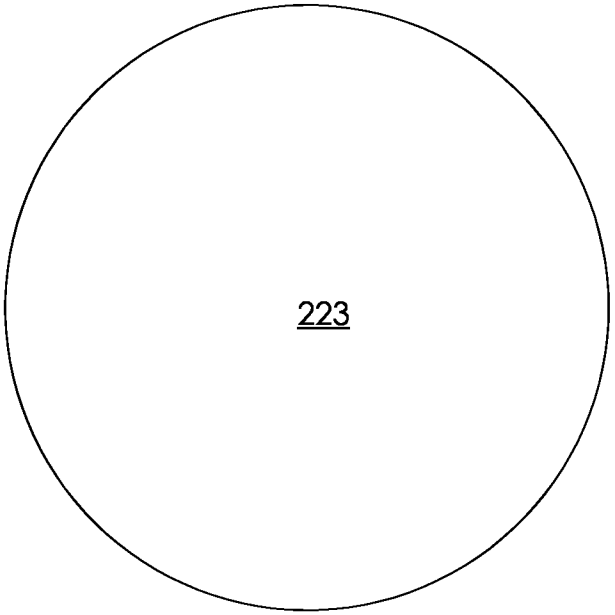
FIG. 9 is a cross-sectional view depicting a cross section of a third gripping segment of the intermediate portion according to an embodiment of the present invention.
Figure 10:
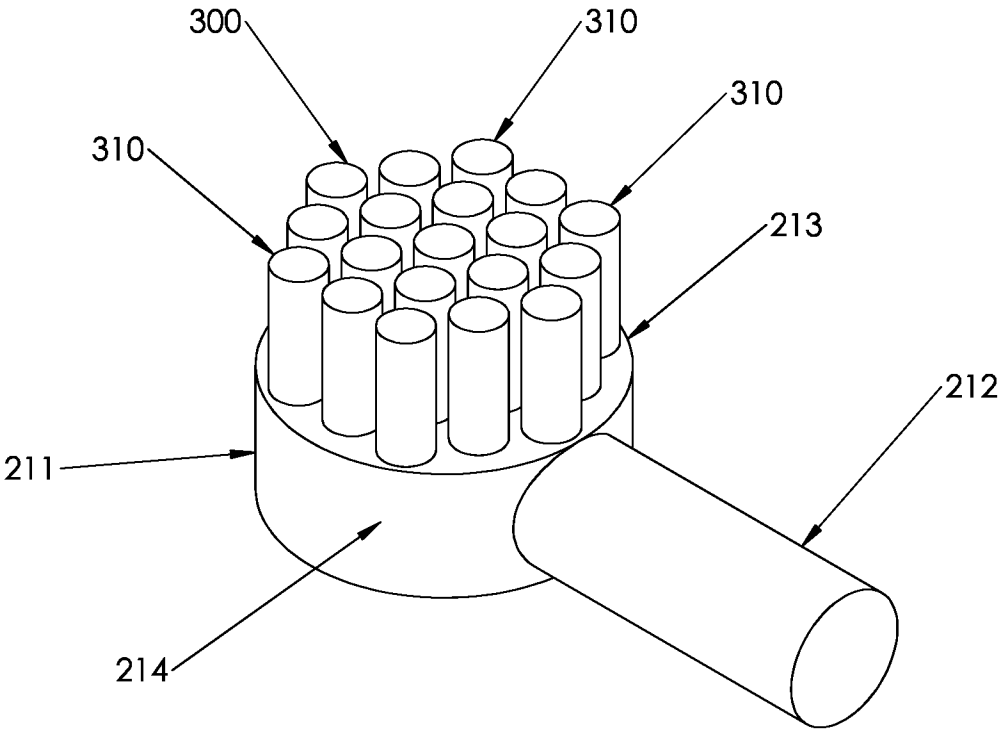
FIG. 10 is a perspective view depicting the first brush connected with the first portion having a plate segment and a first neck segment according to an embodiment of the present invention.
Figure 11:
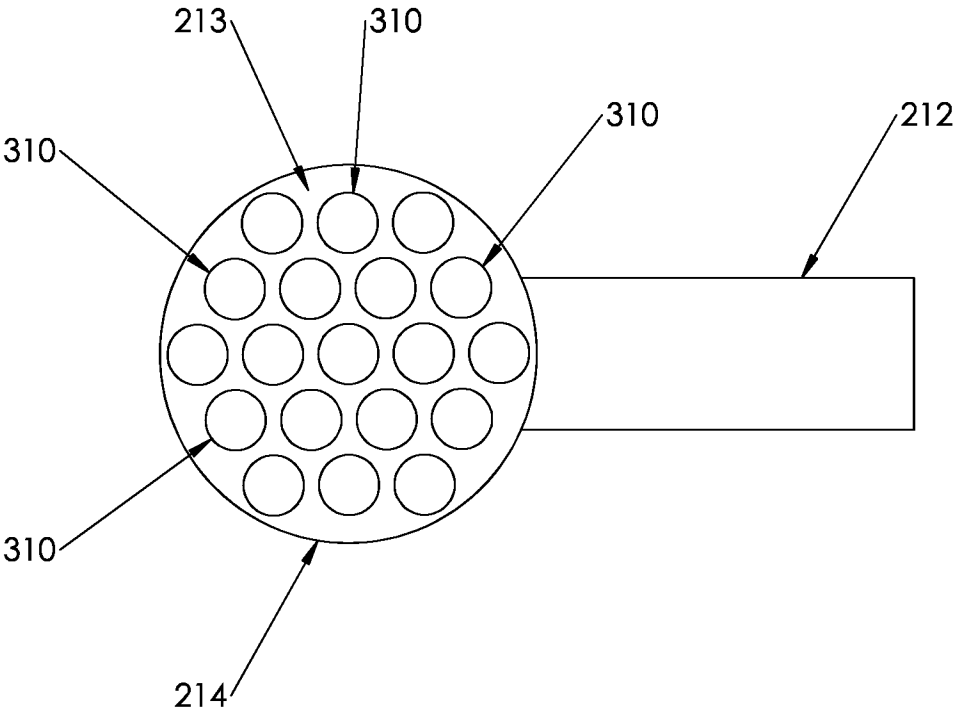
FIG. 11 is a top view depicting the first brush connected with the first portion according to an embodiment of the present invention.
Figure 12:
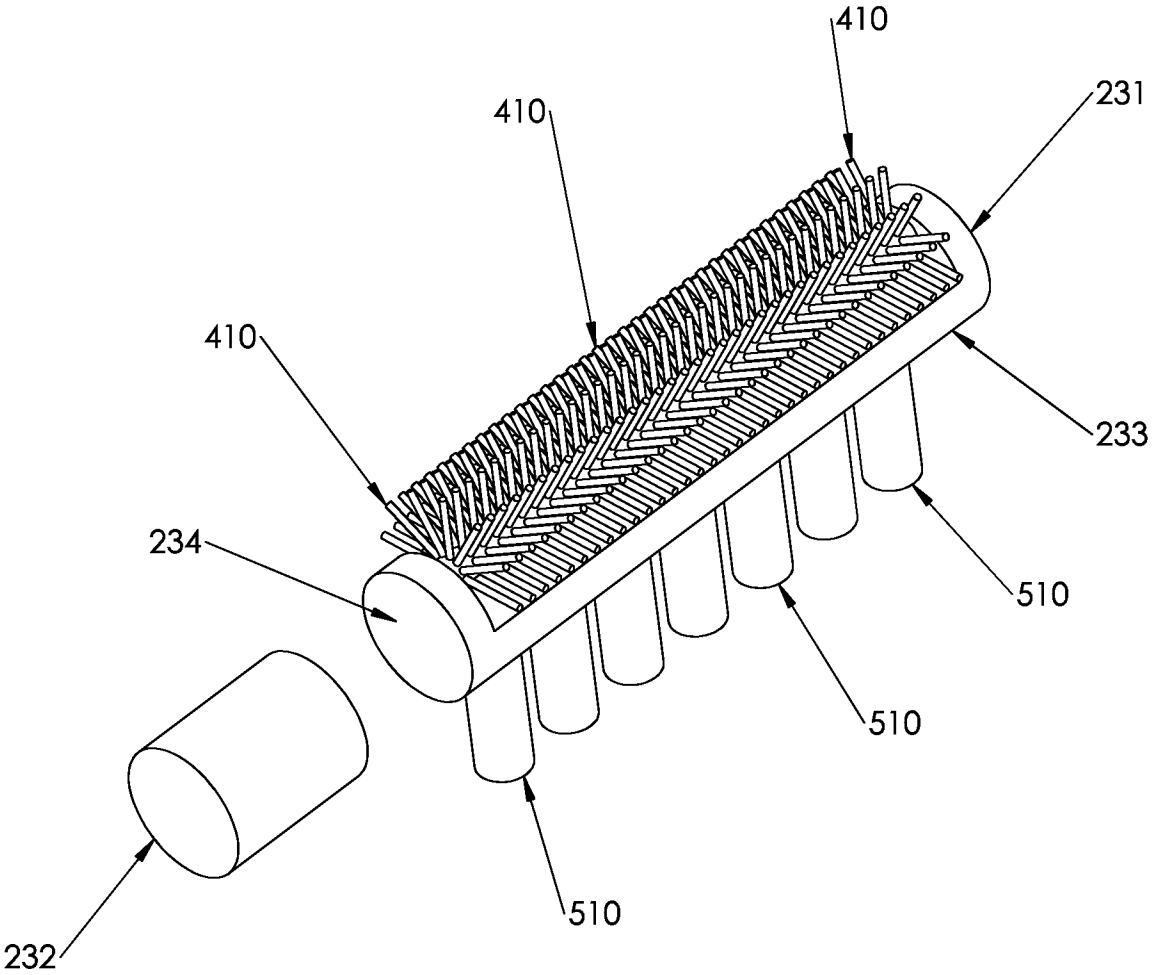
FIG. 12 is a perspective view depicting the second brush and the third brush connected with the second portion having a rod segment and a second neck segment according to an embodiment of the present invention.
Figure 13:
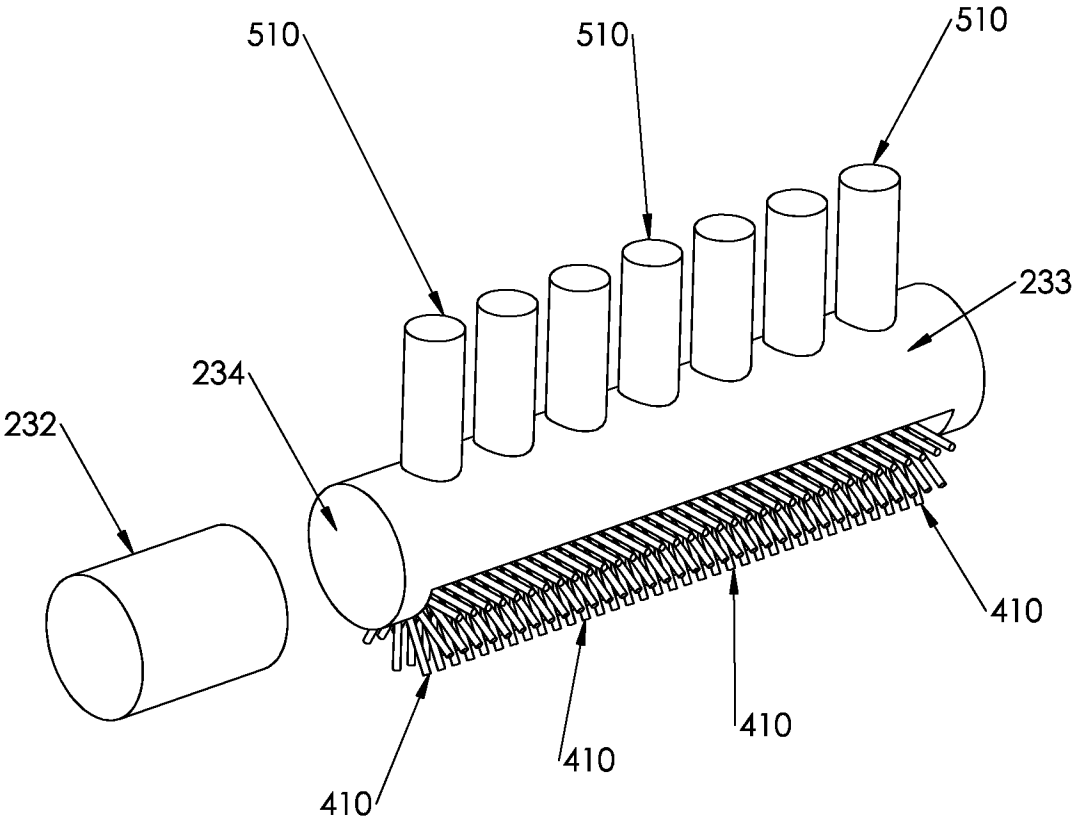
FIG. 13 is another perspective view depicting the second brush and the third brush connected with the second portion according to an embodiment of the present invention.
Figure 14:
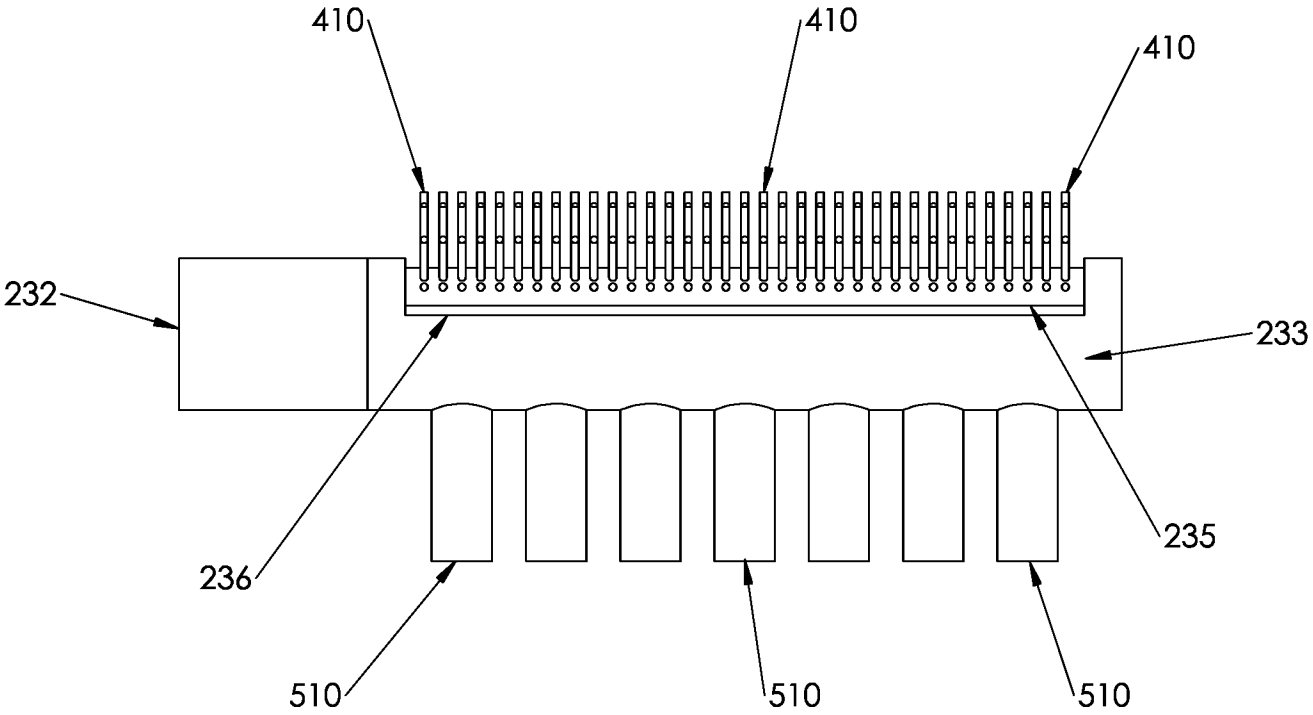
FIG. 14 is a front view depicting the second brush and the third brush connected with the second portion according to an embodiment of the present invention.
Figure 15:
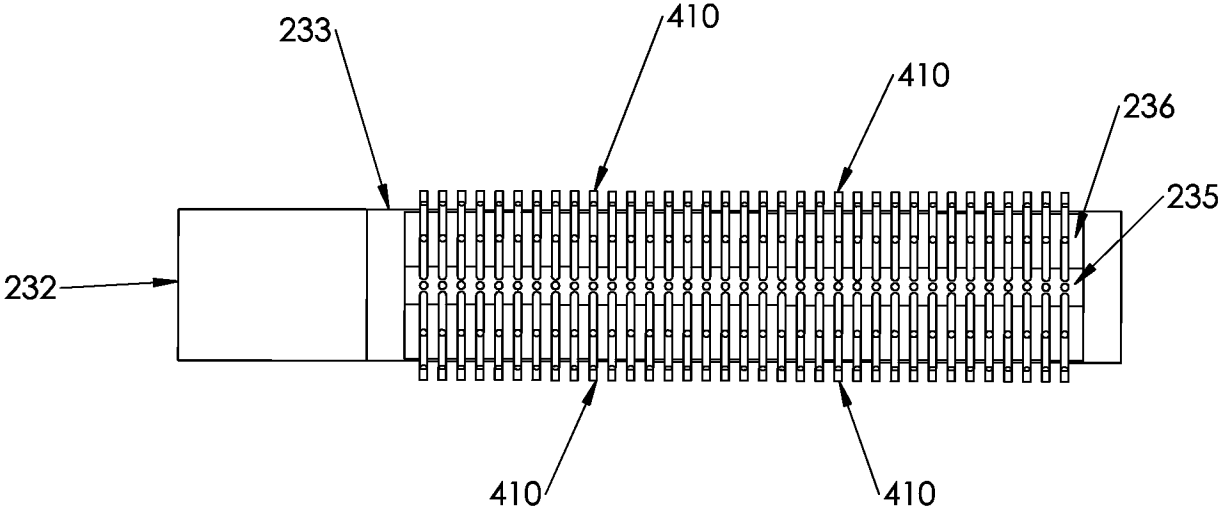
FIG. 15 is a top view depicting the second brush connected with the second portion according to an embodiment of the present invention.
Figure 16:
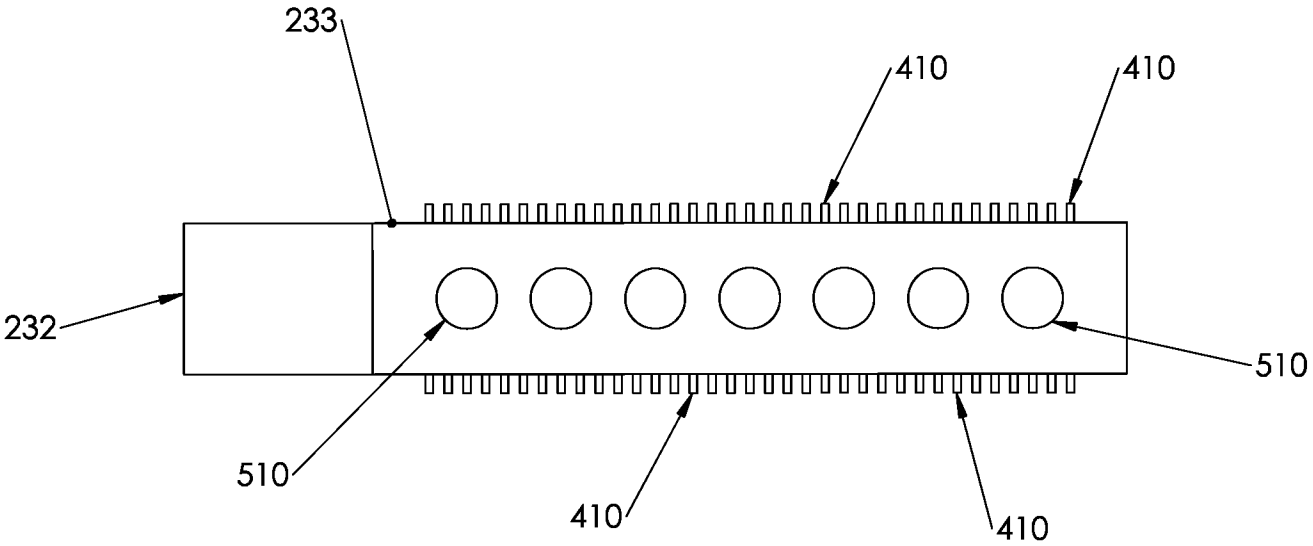
FIG. 16 is a bottom view depicting the third brush connected with the second portion according to an embodiment of the present invention.
Figure 17:
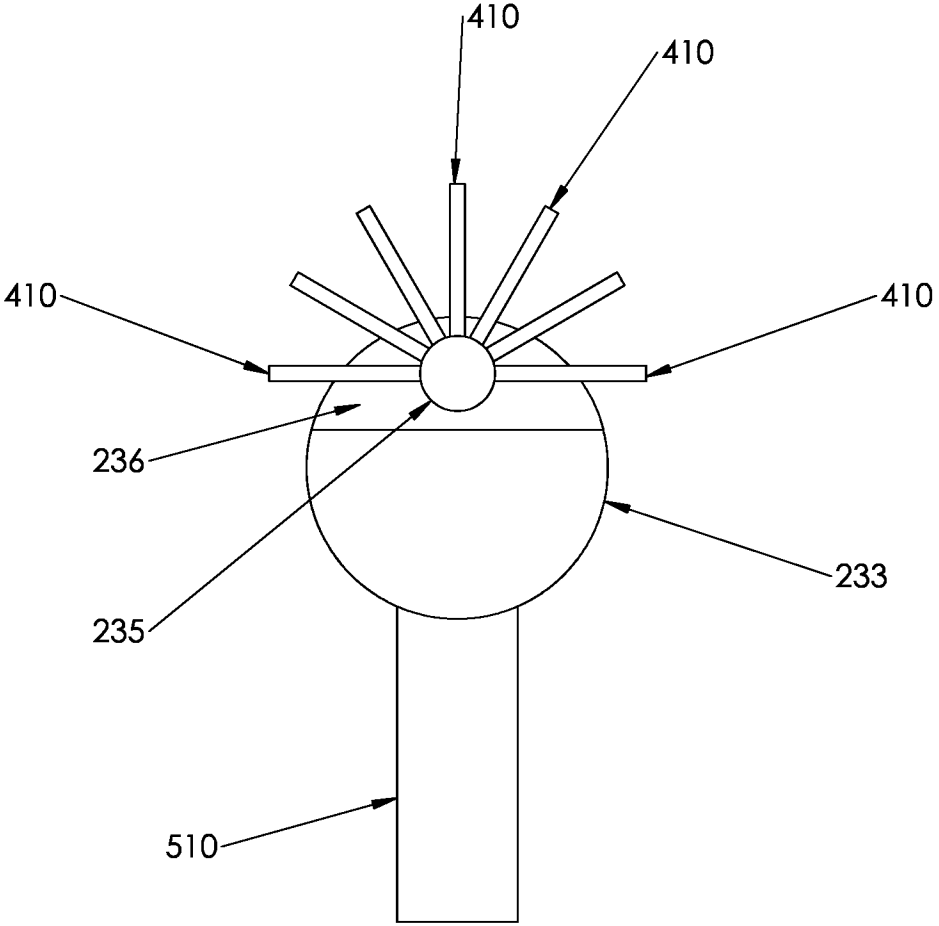
FIG. 17 is a cross-sectional view depicting a cross section of the second brush and the third brush connected with the second portion according to an embodiment of the present invention.

Please refer to FIGS. 1-17, the present invention provides a brush apparatus 100. The brush apparatus 100 comprises a handle 200, a first brush 300, a second brush 400 and a third brush 500.

The handle 200 is connected in between the first brush 200 and the second brush 400, and is further connected in between the first brush 200 and the third brush 500. Specifically, the handle 200 is an elongated handle, and each of the first brush 300, the second brush 400 and the third brush 500 is a soft brush. The handle 200 is extended in a longitudinal direction. The handle 200 comprises a first end portion 210, an intermediate portion 220 and a second end portion 230.

The intermediate portion 220 is connected in between the first end portion 210 and the second end portion 230. The intermediate portion 220 comprises a first gripping segment 221, a second gripping segment 222 and a third gripping segment 223. The first gripping segment 221 is connected with the first end portion 210, the second gripping segment 222 is connected with the second end portion 230, and the third gripping segment 223 is connected in between the first gripping segment 221 and the second gripping segment 222. Particularly, a part of the first gripping segment 221 adjacent to the first end portion 210 converges or is tapered in a direction from the third gripping segment 223 towards the first end portion 210, and a part of the second gripping segment 222 adjacent to the second end portion 230 converges or is tapered in a direction from the third gripping segment 223 towards the second end portion 230.

A cross section of each of the first gripping segment 221 and the second gripping segment 222 is of substantial-hexagram-shaped. Alternatively, a cross section of each of the first gripping segment 221 and the second gripping segment 222 is of substantial-hexagonal-shaped. A cross section of the third gripping segment 223 is of circular-shaped.

Specifically, the first gripping segment 221 comprises six first ridges 224 and six first grooves 225. Each of the six first ridges 224 is extended from the third gripping segment 223 towards the first end portion 210, and each of the six first grooves 225 is extended from the third gripping segment 223 towards the first end portion 210. One end of the first ridge 224 and one end of the first groove 225 are connected with the third gripping segment 223, while the other end of the first ridge 224 and the other end of the first groove 225 are converged at the first end portion 210. The six first ridges 224 are evenly spaced with one another, and the six first grooves 225 are evenly spaced with one another. Particularly, a corresponding first groove among the six first grooves 225 is located in between two adjacent first ridges among the six first ridges 224. In other words, a corresponding first ridge among the six first ridges 224 is located in between two adjacent first grooves among the six first grooves 225. For example, the first ridge 224 is a rounded convex, while the first groove 225 is a rounded concave.

Specifically, the second gripping segment 222 comprises six second ridges 226 and six second grooves 227. Each of the six second ridges 226 is extended from the third gripping segment 223 towards the second end portion 230, and each of the six second grooves 227 is extended from the third gripping segment 223 towards the second end portion 230. One end of the second ridge 226 and one end of the second groove 227 are connected with the third gripping segment 223, while the other end of the second ridge 226 and the other end of the second groove 227 are converged at the second end portion 230. The six second ridges 226 are evenly spaced with one another, and the six second grooves 227 are evenly spaced with one another. Particularly, a corresponding second groove among the six second grooves 227 is located in between two adjacent ridges among the six second ridges 226. In other words, a corresponding second ridge among the six second ridges 226 is located in between two adjacent second grooves among the six second grooves 227. For example, the second ridge 226 is a rounded convex, while the second groove 227 is a rounded concave.

The first end portion 210 comprises a plate segment 211 and a first neck segment 212. The plate segment 211 comprises a lateral surface 213 and a peripheral surface 214. The peripheral surface 214 is perimetrically connected with the lateral surface 213. The first neck segment 212 is connected in between the peripheral surface 214 and the first gripping segment 221 of the intermediate portion 220. In one example, the plate segment 211 is of circular-shaped. In one example, the first neck segment 212 is of cylindrical-shaped. In one example, the lateral surface 213 is a flat surface, while the peripheral surface 214 is a curved surface. Particularly, a part of the first gripping segment 221 adjacent to the first end portion 210 converges or is tapered in a direction from the third gripping segment 223 towards the first neck segment 212 of the first end portion 210 by the six first ridges 224 and the six first grooves 225 converging towards the first neck segment 212.

The second end portion 230 comprises a rod segment 231 and a second neck segment 232. The rod segment 231 comprises a lateral face 233 and an end face 234. The lateral face 233 is perimetrically connected with the end face 234. The neck segment 232 is connected in between the end face 234 and the second gripping segment 222 of the intermediate portion 220. In one example, each of the rod segment 231 and the second neck segment 232 is of cylindrical-shaped. In one example, the lateral face 233 is a curved surface, while the end face 234 is a flat surface. Particularly, a part of the second gripping segment 222 adjacent to the second end portion 230 converges or is tapered in a direction from the third gripping segment 223 towards the second neck segment 232 of the second end portion 230 by the six second ridges 226 and the six second grooves 227 converging towards the first neck segment 212.

Each of the first brush 300, the second brush 400 and the third brush 500 is laterally connected with the handle 200. An extension line of each of the first brush 300, the second brush 400 and the third brush 500 intersects with an extension line of the handle 200. Specifically, each of the first brush 300, the second brush 400 and the third brush 500 is extended in a latitudinal direction with respect to the handle 200. Specifically, each of the first brush 300, the second brush 400 and the third brush 500 is perpendicularly connected with the handle 200. The second brush 400 and the third brush 500 are located adjacent to each other. Specifically, each of the plurality of second bristles 410 and each of the plurality of third bristles 510 are located opposite to each other about the rod segment 231 of the second end portion 230.

The first brush 300 comprises a plurality of first bristles 310, and the plurality of first bristles 310 are distributed in a hexagonal array. In other words, the outermost first bristles among the plurality of first bristles 310 form a hexagonal contour. The plurality of first bristles 310 are laterally connected with the first end portion 210. An extension line of each of the plurality of first bristles 310 intersects with the extension line of the handle 200. Particularly, an extension line of each of the plurality of first bristles 310 is perpendicular to the extension line of the handle 200. Specifically, the plurality of first bristles 310 are connected with the lateral surface 213. Particularly, the plurality of first bristles 310 are distributed in the hexagonal array on the lateral surface 213. Additionally, each of the plurality of first bristles 310 is erected from the lateral surface 213. For example, each of the plurality of first bristles 310 is made of a non-toxic vegetable based nylon material.

The second brush 400 comprises a plurality of second bristles 410, and the plurality of second bristles 410 are distributed in a partial-radial array. In other words, on a latitudinal plane transverse to the longitudinal direction, the plurality of second bristles 410 are radially extended about the longitudinal direction. Particularly, the partial-radial array is a semi-radial array, i.e., a radial array of about 180 degrees. The plurality of second bristles 410 are laterally connected with the second end portion 230. An extension line of each of the plurality of second bristles 410 intersects with the extension line of the handle 200. Particularly, an extension line of each of the plurality of second bristles 410 is perpendicular to the extension line of the handle 200. In other words, the latitudinal plane is perpendicular to the longitudinal direction.

Specifically, the rod segment 231 comprises a shaft 235. The shaft 235 is longitudinally disposed on the lateral face 233. The plurality of second bristles 410 are connected with the shaft 235. Particularly, the plurality of second bristles 410 are distributed in the partial-radial array on the shaft 235. Additionally, each of the plurality of second bristles 410 is erected from the shaft 235. The rod segment 231 further comprises a recess 236. The recess 236 laterally traverses into the lateral face 233. The shaft 235 is longitudinally inserted into the recess 236. Accordingly, each of the plurality of second bristles 410 is partially accommodated with the recess 236 and partially exposed outside the recess 236. For example, each of the plurality of second bristles 410 is made of a non-toxic vegetable based nylon material.

The third brush 500 comprises a plurality of third bristles 510, and the plurality of third bristles 510 are distributed in a linear array. In other words, the plurality of third bristles 510 are arranged in a straight line. Alternatively, the plurality of third bristles 510 are arranged in a waved line or a bended line. The plurality of third bristles 510 are laterally connected with the second end portion 230. An extension line of each of the plurality of third bristles 510 intersects with the extension line of the handle 200. Particularly, an extension line of each of the plurality of third bristles 510 is perpendicular to the extension line of the handle 200. Specifically, the plurality of third bristles 510 are connected with the lateral face 233. Particularly, the plurality of third bristles 510 are distributed in the linear array on the lateral face 233. Additionally, each of the plurality of third bristles 510 is erected from the lateral face 233. For example, each of the plurality of third bristles 510 is made of a non-toxic vegetable based nylon material.

The brush apparatus 100 of the present invention is a 3 in 1 double-ended, beauty brush apparatus with one of its functions being to exfoliate lips and remove dead skin cells in a safe, gentle, yet effective manner. The brush apparatus 100 specifically replaces the most misused, widely accepted, outdated, unhygienic methods used. The brush apparatus 100 is an apparatus that combines exfoliating actions of hexagonal, 180°, and linear-shaped brushes.

The brush apparatus 100 is a 3-tiered apparatus. In the brush apparatus 100, the first brush 300 is used as a "Hex Applicator Brush," the second brush 400 is used as a "180° Dual-Action Brush," and the third brush 500 is used as a "Linear Precision Brush."

A key function for the present invention is leveraged by combining several types of motion into one apparatus to stimulate blood flow to the skin's surface. Each of the three components, i.e., the first brush 300, the second brush 400 and the third brush 500, is uniquely crafted to offer a specific type of mechanical motion, all of which are geared to increase circulation to various parts of the mouth, while targeting key areas including, but not limited to, the outermost lining of the lip and cupid's bow.

The combined effect of the first brush 300, the second brush 400 and the third brush 500 enhances the plumpness of lips. When the brush apparatus 100 is paired with a lip scrub and utilizes the recommended multi-directional motions, the lips plump, leaving a flake-free canvas ideal for makeup application. This allows the brush apparatus 100 to exceed the efficiency of using one's finger, mascara wand, washcloth, and most importantly, an old, current, or new toothbrush, for optimal results.

In the brush apparatus 100, the handle 200 is used as a "Hex Grip Handle." The handle 200 is modeled after the most powerful shape in nature, the hexagon or the hexagram. The six first ridges 224 and six first grooves 225 and the six second ridges 226 and six second grooves 227 of the handle 200 make it convenient and comfortable for both right and left-handed users. The size of the handle 200 makes it easy to interchange between the double-sided ends and lightweight enough to switch between vertical, horizontal, or circular motions.

In the brush apparatus 100, the first brush 300, i.e., the "Hex Applicator Brush," is specifically set out to leverage the fact that the shape of a hexagon utilizes the least possible surface area and contains maximum volume, while the handle 200, i.e., the "Hex Grip Handle," is specifically set out to leverage the fact that the shape of a hexagon or a hexagram utilizes the least possible surface area and contains maximum volume.

The first brush 300 is a soft-bristled brush. The first brush 300 accommodates all lip sizes and offers full surface exfoliating and plumping actions by increasing circulation through application of a uniform, circular motion to the top and bottom lip. As an exfoliating brush, a first functional use of the first brush 300 comprises sloughing off dry, chapped skin from the lips of the user with the plurality of non-toxic vegetable based first bristles 310. The plurality of non-toxic vegetable based nylon first bristles 310 fan out for greater surface area coverage, are up to twice as soft, lasts 2 to 3 times longer than nylon-only bristles, and are 100% petroleum free. The second function of the first brush 300 is to serve as a lip scrub applicator. Presently, there are no available products purposefully created nor designed to properly address the unique sensitivity and hygienic requirements of the lips. The first brush 300, i.e., the "Hex Applicator Brush," offers a more thorough, proper way to prime and prep the lips, making them ready for glosses, lipsticks, etc.

In the brush apparatus 100, the second brush 400, i.e., the "180° Dual-Action Brush," is used to perform a reciprocating motion, both vertically (up and down) and horizontally (left and right), as well as a circular motion to maximize results and user specific preferences. The dual-action refers to the two types of mechanical motions used, making the second brush 400 one of the most multifaceted components in the brush apparatus 100 with infinite applications. The design of the second brush 400 allows it to maneuver easily in tight, smaller areas, as well as being effective enough for larger surface areas. The unique design of the second brush 400 permits both detailed exfoliation of crevices and hard-to-reach corners of the mouth, while still being able to support full surface exfoliation. Additionally, the second brush 400 is crafted to remove any dry, flaking, or peeling of the skin around the lining of the mouth, and even the two outermost corners.

In the brush apparatus 100, the third brush 500, i.e., the "Linear Precision Brush," is used to perform a reciprocating, back and forth motion to provide the utmost attention to detail. The third brush 500 is thin enough to navigate all of the most tight-knit crevices and corners of the mouth, making it the most fine-tuned, precision-based component. By following along the outer lining of the lips, the third brush 500 can attend to peeling or flaky skin, often experienced by lip-lickers. Moreover, targeting areas such as the cupid's bow is ideal for the third brush 500, making a typically hard-to-reach area, easy-to-do. This lip priming action performed by the third brush 500, allows users to apply lip liners evenly, especially those who elect to outline just above the cupid's bow or slightly outside the lip's lining for a fuller effect. In order to seamlessly transition from the lip's surface to the facial skin, an even platform must be achieved prior to makeup application. When integrated with one's beauty routine, this practice offers longer-lasting results for makeup, allowing less product waste and reapplication.

in the brush apparatus 100, the first brush 300, the second brush 400 and the third brush 500, i.e., the "Hex Applicator Brush," the "180° Dual-Action Brush" and the "Linear Precision Brush," encompass different kinds of motion, and combinations, to serve as a lip prep tool to provide a smooth, even surface for moisturizers and products such as lipstick, lip balm, lip gloss, and concealers. The flake-free surface is makeup ready, and ideal for long wear usage of lip products, including matte lipsticks. Benefits are maximized when the brush apparatus 100 of the present invention is used as a lip scrub applicator, including DIY all-natural products, by enhancing the effects of the exfoliation. A modular version with interchangeable brush with various shapes, sizes, bristles and angles, that includes the use of organic, synthetic, charcoal, microfiber, plant based, vegetable based nylon and/or other types of bristles are planned modifications and variations.

Although the invention has been explained in relation to its preferred embodiment, it is to be understood that many other possible modifications and variations can be made without departing from the spirit and scope of the invention.

What is claimed is:

1. A brush apparatus comprising:
a handle;
a first brush;
a second brush;
a third brush;
the handle being connected in between the first brush and the second brush;
the handle being connected in between the first brush and the third brush;
the second brush and the third brush being located adjacent to each other;
each of the first brush, the second brush and the third brush being laterally connected with the handle;
the first brush comprising a plurality of first bristles;
the plurality of first bristles being distributed in a hexagonal array;
the second brush comprising a plurality of second bristles;
the plurality of second bristles being distributed in a partial-radial array;
the third brush comprising a plurality of third bristles; and
the plurality of third bristles being distributed in a linear array.

2. The brush apparatus as claimed in claim 1 comprising:
the partial-radial array being a semi-radial array.

3. The brush apparatus as claimed in claim 1 comprising:
the handle comprising a first end portion, an intermediate portion and a second end portion;
the intermediate portion being connected in between the first end portion and the second end portion;
the plurality of first bristles being laterally connected with the first end portion;
the plurality of second bristles being laterally connected with the second end portion; and
the plurality of third bristles being laterally connected with the second end portion.

4. The brush apparatus as claimed in claim 3 comprising:
each of the plurality of second bristles and each of the plurality of third bristles being located opposite to each other about the second end portion.

5. The brush apparatus as claimed in claim 3 comprising:
the intermediate portion comprising a first gripping segment and a second gripping segment;
the first gripping segment being connected with the first end portion; and
the second gripping segment being connected with the second end portion.

6. The brush apparatus as claimed in claim 5 comprising:
a cross section of each of the first gripping segment and the second gripping segment being of substantial-hexagram-shaped.

7. The brush apparatus as claimed in claim 5 comprising:
a cross section of each of the first gripping segment and the second gripping segment being of substantial-hexagonal-shaped.

8. The brush apparatus as claimed in claim 5 comprising:
each of the first gripping segment and the second gripping segment comprising six ridges and six grooves, the six ridges being evenly spaced with one another, the six grooves being evenly spaced with one another, a corresponding groove among the six grooves being located in between two adjacent ridges among the six ridges.

9. The brush apparatus as claimed in claim 5 comprising:

the intermediate portion comprising a third gripping segment;

the third gripping segment being connected in between the first gripping segment and the second gripping segment; and a cross section of the third gripping segment being of circular-shaped.

10. The brush apparatus as claimed in claim 3 comprising:

the first end portion comprising a plate segment and a first neck segment;

the plate segment comprising a lateral surface and a peripheral surface;

the peripheral surface being perimetrically connected with the lateral surface; and the first neck segment being connected in between the peripheral surface and the intermediate portion.

11. The brush apparatus as claimed in claim 10 comprising:

the plurality of first bristles being connected with the lateral surface; and the plurality of first bristles being distributed in the hexagonal array on the lateral surface.

12. The brush apparatus as claimed in claim 10 comprising:

each of the plurality of first bristles being erected from the lateral surface.

13. The brush apparatus as claimed in claim 3 comprising:

the second end portion comprising a rod segment and a second neck segment;

the rod segment comprising a lateral face and an end face;

the lateral face being perimetrically connected with the end face; and the second neck segment being connected in between the end face and the intermediate portion.

14. The brush apparatus as claimed in claim 13 comprising:

the rod segment comprising a shaft; and the shaft being disposed on the lateral face.

15. The brush apparatus as claimed in claim 14 comprising:

the plurality of second bristles being connected with the shaft; and the plurality of second bristles being distributed in the partial-radial array on the shaft.

16. The brush apparatus as claimed in claim 14 comprising:

each of the plurality of second bristles being erected from the shaft.

17. The brush apparatus as claimed in claim 14 comprising:

the rod segment comprising a recess;

the recess laterally traversing into the lateral face;

the shaft being inserted into the recess; and the plurality of second bristles being connected with the shaft.

18. The brush apparatus as claimed in claim 17 comprising:

each of the plurality of second bristles being partially accommodated with the recess and partially exposed outside the recess.

19. The brush apparatus as claimed in claim 13 comprising:

the plurality of third bristles being connected with the lateral face; and the plurality of third bristles being distributed in the linear array on the lateral face.

20. The brush apparatus as claimed in claim 13 comprising:

each of the plurality of third bristles being erected from the lateral face.

* * * * *